United States Patent [19]

Schuyler et al.

[11] 4,379,554

[45] Apr. 12, 1983

[54] PLATFORM TENNIS PADDLE

[75] Inventors: Andreas D. Schuyler, Wyckoff; Richard K. Maier, Allendale, both of N.J.

[73] Assignee: Skymar Corporation, Wyckoff, N.J.

[21] Appl. No.: 295,733

[22] Filed: Aug. 24, 1981

[51] Int. Cl.[3] ..... A63B 59/00

[52] U.S. Cl. ..... 273/67 R; 273/76

[58] Field of Search ..... 273/73 C, 73 D, 73 J, 273/73 L, 76, 30, 67 R

[56] References Cited

U.S. PATENT DOCUMENTS 2,268,893 1/1942 Nielsen ..... 273/76
4,062,541 12/1977 Marks ..... 273/73 C

FOREIGN PATENT DOCUMENTS 7410506 2/1975 Netherlands ..... 273/76
428582 5/1935 United Kingdom ..... 273/76

*Primary Examiner*—Richard C. Pinkham
*Assistant Examiner*—S. R. Crow
*Attorney, Agent, or Firm*—Siegmar Silber

[57] ABSTRACT

An improved platform tennis paddle is provided that is constructed with two outer laminated ply structures and inner laminated ply structure therebetween. The inner laminated ply structure has a central aperture therethrough which in the preferred embodiment is filled with a resilient plug. The edge of the paddle is protected by a T-shaped molding fitted in to the perimeter of the paddle, and to safeguard against de-lamination the handle is of pegged construction.

3 Claims, 4 Drawing Figures

PLATFORM TENNIS PADDLE

BACKGROUND OF THE INVENTION

1. Field of the Invention

This invention relates to an improved platform tennis paddle, and more particularly to a laminated paddle having a resilient central area or "sweet spot". The paddle also resists delamination in active use.

2. Background of the Prior Art

In the past, many paddles and rackets have been designed for tennis, platform tennis, racketball, paddle tennis, badminton and similar sports. Various means have been sought to obviate problems with wooden paddles, such means include sandwiching the wood laminate between metal layers or encasing the body of the paddle in heavy coatings. While these approaches have possibly reduced the cracking, warping and chipping of the wood surface, they also have detracted from the playing characteristics inherent in a substantially all wood construction.

Rackets have also heretofore been promoted with more resilient structures than merely all laminated hardwoods. These have included some of the striations being constructed of foamed plastic or rubber, balsa wood layers, or cork. However, these structures have lacked durability and typically de-laminate in vigorous play.

Prior to the preparation of this application a patentability search was peformed in Class 273, subclasses 67, 73, 76, 77, 411 and 417 and Class 2, subclass 26. This search uncovered the following patents: 4,189,142, deVries, February 19, 1980; 3,162,443, Petri, December 22, 1964; 4,062,541, Marks, December 13, 1977; 2,268,893, Nielsen, January 6, 1942; 717,504, Longfellow, December 30, 1902.

An opinion was rendered that none of the patents cited fully anticipated the disclosure and, the patents, when taken in various combinations, did not render the disclosure obvious or teach toward the structure of the present invention.

SUMMARY OF THE INVENTION

In summary, according to the present invention, a platform tennis paddle is provided that is constructed with two outer laminated ply structures and an inner laminated ply structure therebetween. The inner laminated ply structure has a central aperture therethrough. The central aperture is, in the preferred embodiment, filled with a resilient plug of balsa wood, rubber composition, or foamed plastic. The edge of the paddle is protected by a T-shaped molding fitted in to the perimeter, and to safeguard against delamination the handle is of pegged cosntruction.

Accordingly, it is an object of the present invention to provide an improved platform tennis paddle of substantially all-wood construction having a lively and responsive playing surface.

A further object of this invention is to provide a paddle that withstands vigorous play without de-lamination.

A yet further object of this invention is to provide a paddle that is shock absorbing.

Other objects and features of the invention will be apparent from reading the specification hereof.

The invention comprises the features of construction, combinations of elements, and arrangements of parts which is exemplified in the platform tennis paddle construction set forth; however, the technique described is applicable to other solid racquet sports, particularly paddle tennis and paddle ball. The scope of the invention will be indicated in the claims.

BRIEF DESCRIPTION OF THE DRAWINGS

The invention will now be described with reference to the accompanying drawings, in which.

Similar reference numerals refer to similar parts throughout the several views.

DESCRIPTION OF THE PREFERRED EMBODIMENT

Figure 1:
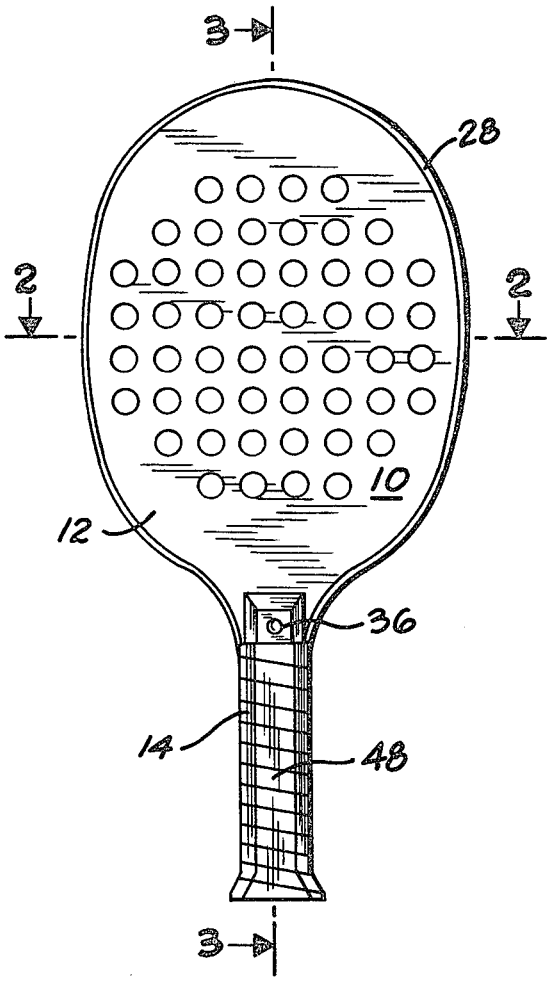
FIG. 1 is a plan view of the platform tennis paddle showing the present invention.
Figure 3:
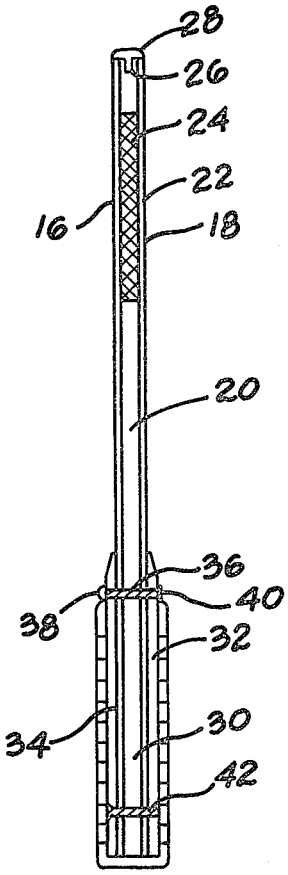
FIG. 3 is a sectional view taken along line 3–3 of FIG. 1 showing the details of the handle construction.

The paddle device of this invention is shown in FIG. 1 and is referred to generally as 10. The paddle device is constructed to include a blade portion 12 formed from laminated materials and a handle portion 14. As is more clearly seen in the cross-sectional view, FIG. 2, the blade portion 12 is in turn formed from three laminated plies, namely two outer ply structures 16 and 18, respectively, and an inner ply structure 20. Of the inner ply structure 20, the central portion 22 thereof is removed and the aperture is filled with a resilient plug 24 constructed of material such as balsa wood, rubber composition, foamed plastic and the like. The perimeter of the paddle is constructed with a groove 26 for acceptance of a rim or T-shaped molding or edge guard 28. Throughout the major portion of the blade 12, there is constructed an array of as many as eight-seven holes which thereby lightens the total weight of the structure and, in play, improves the spin characteristics imparted to the ball.

Figure 4:
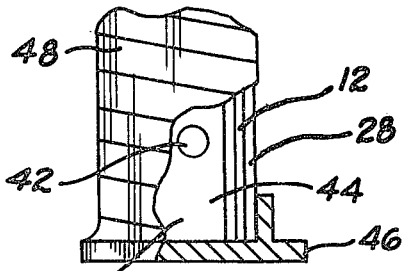
FIG. 4 is a partially cutaway view showing the details of the grip and butt construction.
Figure 2:
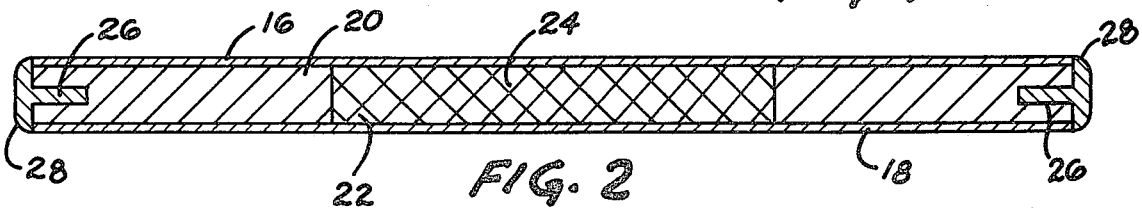
FIG. 2 is a sectional view taken along line 2–2 of FIG. 1 showing the resilient central core.

Reference is now made to FIGS. 2 and 4 in which the details of the handle portion 14 are shown. The laminated paddle body is structed so that an extension 30 thereof forms the center layer of the sandwich-type handle. For durability the edge guard 28 is continued into the handle portion. Upon each side of the extension 30, one of the half handles 32 and 34 is attached. At least two pegs or dowels are included in the paddle construction to lock together the laminations and the handle pieces. Upper dowel 36 is inserted in the center of the upper handle beyond the wrapped grip area and decorative plugs or buttons 38 and 40 are inserted at either end thereof. Lower dowel 42 is inserted in the center of the lower handle and is mounted flush with the half handle outer surfaces. One or more pegs (not shown) may optionally be inserted intermediate upper dowel 36 and lower dowel 42. The butt of the handle 44 is constructed to include a butt cover 46 which is glued or similarly attached to the end of the handle portion. The handle is then finished by encasing it with a grip assembly having shock absorbing characteristics. Most popularly the grip is formed from an elongated strip 48 preferably of leather, which is wrapped helically about the handle portion and covers from the butt cover 46 to just below the upper dowel 36.

In manufacturing the platform tennis paddle of this invention, the optimum central aperture has been found empirically. By providing in the inner ply structure a proportion of the areas of the aperture to the uncut inner ply of not more than 50%, the strength of the structure is maintained and the resilient "sweet spot" effect is maximized. While various plywoods have been employed, including birch, maple, fir and combinations of similar woods, the most satisfactory product has been produced from five-ply birch plywood.

In playing platform tennis with the paddle of this invention, it has been found that the paddle produces greater resiliency and imparts unexpectedly greater velocity and spin to the ball. It is postulated by the inventor that the hole structure provides the spin and that the compression of the outer ply above the resilient plug sufficiently distorts the hole profile so as to provide extra spin.

While the paddle of this invention has been described as applied to platform tennis, the invention is suitable for other solid racket sports including but not limited to, paddle tennis and paddleball. Further, while the form of the device shown herein and described is adapted to fulfill the stated objects, it is to be understood that is not intended to limit the invention to the preferred embodiment which is included as the "best mode" of practicing the invention. Slight variations of the disclosed structure as anticipated to be included within the language of the claims which follow.

We claim:

1. A platform tennis paddle comprising in combination:

a. a blade portion in turn comprising in combiantion;

(1) an inner laminated ply structure having uniform thickness defined by opposed substantially planar surfaces;

(2) a central aperture in said inner laminated ply structure;

(3) a pair of outer laminated ply structures having substantially planar surfaces, each one attached to one of said opposed substantially planar surfaces of said inner laminated ply structures;

(4) said blade portion including a plurality of holes being defined by said inner and outer ply structures;

(5) resilient plug means for insertion into said central aperture dimensioned to fit therewithin;

b. a handle portion in turn comprising in combination:

(1) a pair of half-handles attached to either side of said blade portion; (and)

(2) plurality of peg means for securing the ply structures to said half-handles;

(3) grip means for encasing said half-handles(.) ; and, c. wherein said central aperture is less than 50 percent of the area of said blade portion.

2. A platform tennis paddle as described in claim 1 wherein said blade portion further includes a T-shaped molded rim protector.

3. A platform tennis paddle as described in claim 2 wherein said laminated ply structures are plywood.

* * * * *